United States Patent [19]

Azzi

[11] Patent Number: 4,708,252

[45] Date of Patent: Nov. 24, 1987

[54] STORAGE RACK SYSTEM

[75] Inventor: Victor D. Azzi, Durham, N.H.

[73] Assignee: The Kingston-Warren Corporation, Newfields, N.H.

[21] Appl. No.: 867,897

[22] Filed: May 20, 1986

Related U.S. Application Data

[63] Continuation of Ser. No. 769,994, Aug. 26, 1985, abandoned, which is a continuation of Ser. No. 562,279, Dec. 16, 1983, abandoned.

[51] Int. Cl.[4] ..... A47B 47/00

[52] U.S. Cl. ..... 211/192; 211/187; 108/108; 52/646

[58] Field of Search ..... 211/192, 187, 186, 191, 211/189, 206, 57.2, 153, 134, 135, 128; 108/107, 108, 109, 1; 312/42; 52/645, 646, 731

[56] References Cited

U.S. PATENT DOCUMENTS

| | | | |
|---|---|---|---|
| 1,952,111 | 3/1934 | Bales | 108/107 |
| 2,266,206 | 12/1941 | Jackson et al. | 248/243 |
| 2,937,767 | 5/1960 | Butler et al. | 211/187 X |
| 2,963,170 | 12/1960 | Lori | 448/242 |
| 3,009,582 | 11/1962 | Degener | 211/191 |
| 3,332,197 | 7/1967 | Hinkle | 52/731 |
| 3,456,970 | 7/1967 | Sunasky | 211/192 X |
| 3,520,507 | 7/1970 | Strong | 248/188.9 X |
| 3,545,626 | 12/1970 | Seiz | 211/192 |
| 3,562,992 | 2/1971 | Kinsey | 52/731 X |
| 3,606,027 | 9/1971 | Clements | 211/191 |
| 3,611,666 | 10/1971 | Poyser et al. | 52/731 |
| 3,726,414 | 4/1973 | Konstant | 211/191 |
| 3,871,525 | 3/1975 | Al-Dabbaugh | 211/191 |
| 3,900,112 | 8/1975 | Azzi et al. | 211/59.2 X |
| 3,999,875 | 12/1976 | Simon | 211/189 X |
| 4,002,000 | 1/1977 | Howard et al. | 52/731 X |
| 4,038,802 | 8/1977 | Bajorek et al. | 52/731 |
| 4,064,996 | 12/1977 | Shillum | 211/191 |
| 4,069,638 | 1/1978 | Hasselquist et al. | 52/731 X |
| 4,173,934 | 11/1979 | Searby | 108/111 |
| 4,349,171 | 9/1982 | Baldwin | 108/109 X |
| 4,372,451 | 2/1983 | Rasmussen et al. | 211/184 X |

FOREIGN PATENT DOCUMENTS

| | | | |
|---|---|---|---|
| 1522501 | 3/1968 | France | 108/1 |

*Primary Examiner*—Ramon S. Britts
*Assistant Examiner*—Blair M. Johnson
*Attorney, Agent, or Firm*—Cesari and McKenna

[57] ABSTRACT

An especially sturdy storage rack system employs series of moment-resisting eccentric braced vertical frames maintained in spaced relation by horizontal frame members in the form of pallet bars or sway braces releasably coupled to the frames by special connector assemblies. Each connector assembly includes a connector and connector lock which clampingly engage about a specially configured vertical frame column and to each other to produce a connection or joint having a high degree of fixity without imparting excessive localized stresses to the column. An improved mode of adjustably suspending the rack shelving from the vertical frames is also disclosed.

21 Claims, 4 Drawing Figures

STORAGE RACK SYSTEM

This application is a continuation of application Ser. No. 769,994, filed Aug. 26, 1985, now abandoned, which, in turn, was a continuation of Ser. No. 562,279, filed Dec. 16, 1983, now abandoned.

BACKGROUND OF THE INVENTION

This invention relates to a storage rack system. It relates more particularly to a rack assembly composed of one or more modular units or bays arranged in a straight row. Typically, a given system will comprise several such rows with aisles between them to enable stockpersons and order pickers to move between the rows and remove stock from the various bays for transfer to a central location to fill orders.

The rack assemblies can be arranged to store palletized loads or for live storage wherein the stock is supported on inclined gravity-flow shelves. In the latter case, restocking is done at the backs of the shelves and order picking from the fronts. The stock is kept fresh by the gravity feed of the stock toward the shelf fronts assuring storage on a first-in, first-out basis. Such rack assemblies also provide flexible warehousing of merchandise and assure a rack front-filled condition at all times with resultant maximum ease and minimum error of order picking, and simplification of stock control. An example of such a gravity-flow storage rack assembly is disclosed in U.S. Pat. No. 3,900,112.

There are a number of design criteria which such rack systems should meet, many of which are mutually antagonistic. More particularly, the system should be capable of providing both carton flow and pallet flow as well as reserve pallet storage in a wide variety of floor layouts, yet be composed of a minimum number of different parts. Also, the components of the system should be capable of being assembled relatively quickly without any special tools or equipment. Yet, when assembled, those components should combine and coact to create a rack structure or assembly which is capable of supporting heavy loads and which is very stable and able to withstand lateral forces exerted upon it by vehicles loading stores onto the rack shelves, horizontal conveyors supported by the assemblies, earth tremors, etc. Additionally, of course, positive engagements between the components of the rack system are essential to avoid accidental disconnection or dislocation of rack parts. Further economic considerations dictate that such maximum rigidity, ease of installation and economy of parts should be achieved using a minimum of assembly operations so that the storage rack system can be assembled on site by the purchaser of the system without any special training by following simple instructions.

While the rack assemblies of which we are aware, including the one disclosed in the aforementioned patent, satisfy some of the above criteria, they do not satisfy all of the mutually antagonistic requirements for present day rack systems, particularly those extending up two, three, four or more levels. In some cases, the vertical frames are not strong enough; in others, the connections between the various components of the system are not rigid or secure enough. For example, in the assembly described in the aforementioned patent, the vertical frames comprise channels having generally U-shaped cross sections making them somewhat susceptible to torsional-flexural buckling, particularly in the long lengths required for multiple level rack systems. Also, the horizontal frame members or sway braces are connected to the vertical frames by keyed connections that do not prevent all relative movement between the ends of the sway braces and the vertical frames. Consequently, those prior racks are not as rigid and sturdy as they might be, particularly when the racks extend up several levels.

There do exist rack assemblies which attempt to effect more secure connections or joints between the horizontal and vertical frame members of those assemblies with the objective of minimizing sway and maximizing the rigidity of the overall assembly. Examples of those racks are disclosed in U.S. Pat. Nos. 3,510,010; 3,871,525; 4,027,453 and 4,064,996. They employ special connectors at the ends of the horizontal frame members or braces which hook into the vertical frames with the objective of minimizing rotation of those members relative to the vertical frames and the chances of accidental disengagement of the connectors from the frames. However, even those structures are not as rigid and secure as they might be, particularly when installed in multiple level rack systems. The main reason for this is that the vertical frames are still composed of open channels and the connectors between the horizontal sway braces and those frames do not eliminate all relative motions between the braces and the frames. Moreover, when the racks are subjected to horizontal forces tending to cause the assembly to rack or sway, the connections between the sway braces and vertical frames sometimes cause the walls of the frame channels to bend and tear. Still further, in the prior racks, the mounting of the shelving to the vertical frames is not as convenient and adaptable as it might be.

SUMMARY OF THE INVENTION

Accordingly, the present invention aims to provide an improved storage rack system.

Another object of the invention is to provide a rack system which is unusually rigid, sturdy and moment-resisting even when it extends up to multiple levels.

A further object of the invention is to provide a rack system which is composed of a minimum number of different parts.

Still another object of the invention is to provide a system such as this which can be organized in a variety of different ways to adapt to different floor layouts.

Another object of the invention is to provide a rack system whose components can be assembled easily by relatively unskilled personnel without any special tools.

Yet another object of the invention is to provide improved releasable connections or joints between the horizontal and vertical frame members of a storage rack.

A further object is to provide such a system whose sway braces and pallet bars cannot disengage accidentally from the vertical frames which support them.

Another object is to provide connections of this type which minimize stresses on the vertical frame members at the sites of the connections.

A further object of the invention is to provide a storage rack having improved adjustable connections between its shelf units and vertical frames.

Still another object of the invention is to provide a storage rack capable of supporting a maximum number of shelf units over its vertical extent.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, the present rack system is made up of one or more rack assemblies each of which forms one or more rack units or bays. Each rack assembly comprises a series of two or more spaced-apart special moment-resisting eccentric braced vertical frames. The adjacent vertical frames are themselves specially connected together at their fronts and backs by a series of vertically spaced horizontal frame members such as pallet bars and/or sway braces which maintain the spacing between the vertical frames and prevent those frames from swaying or leaning to one side or the other. In the larger installations, the rack assemblies are usually arranged in straight rows separated by aisles.

A rack system usually includes one or more rack assemblies of a type suitable for storing cartons. This type assembly includes a series of vertically spaced shelf units mounted in the bays between adjacent vertical frames and on which stock or merchandise may be placed. The shelf units may be of the gravity-flow type or the non-gravity flow type; both types of shelving could be employed in a typical system. As usual, the gravity-flow shelf units enable pickers and stockpersons to walk up and down the aisle in front of the shelves and pick stock from the cartons thereon with maximum ease and minimum picking error. Restocking of the various shelves proceeds in the aisle behind the shelves so that the restocking process does not interfere with the picking or order selection going on in front of the shelves.

A given system may also include one or more rack assemblies for storing goods stacked on pallets. This type assembly has a vertical series of sturdy horizontal frame members or pallet bars positioned between the vertical frames and on which the pallets rest. It is used for reserve storage or as a staging area rack for storing merchandise intended for restocking the shelf units of the first mentioned assemblies. Thus in a typical system, these pallet storage racks are positioned on the opposite side of the aisle at the rear of the gravity flow shelving so that, when merchanise is depleted at particular gravity flow shelves, the stockpersons can transfer fresh merchandise from the pallet racks across the aisle to the backs of the empty gravity-flow shelves. With this arrangement, at each rack assembly row of the rack system, the order selection and picking can proceed completely independently of the stocking and restocking activities involving that row.

The rack assemblies of the system can extend up two, three or even more levels to form mezzanines with access to the upper floors being provided by suitable flights of stairs, the required floor trusses and stairs being supported ultimately by the vertical frames of the assemblies comprising the rack system. Usually, these frames extend all the way from the floor to the top of the particular assembly, adjacent frames being connected together and rigidified over their entire heights by the horizontal pallet bars and/or sway braces thus assuring the structural integrity of the system as a whole.

Each vertical frame of the present system is a single welded assembly comprising a pair of spaced-apart interconnected vertical support columns. These are specially designed to withstand, in addition to axial forces due to the gravity loads on them, twisting and racking forces that might be imposed upon them during the useful life of the system due to factors such as impacts by forklift trucks, building vibrations, earth tremors and the like. More particularly, each support column is a bix girder formed as a hollow I-beam whose opposite walls, including the flanged portions thereof, are spaced apart from one another. This closed column construction provides great strength and stiffness to a member required to carry combined axial, bending and torsional loads. This closed construction is also unaffected by the normal tendency of long columns to fail by torsional-flexural buckling, a tendency that plagues virtually all other rack columns.

The columns also cooperate with special connector assemblies about to be described to produce very strong releasable connections or joints between the horizontal sway braces and pallet bars and the columns comprising each rack assembly of the system. These connections between the horizontal members and the columns, which develop fixity through a wedging action that becomes more rigid with increasing loads, permit bending moments to be developed at the connections to better resist vertical and lateral forces. Thus, in this rack system, each horizontal sway brace and pallet bar is terminated by elongated connectors arranged to be releasably engaged to the two vertical frame columns between which the brace or bar extends. Each connector is channel shaped, having a relatively wide limb which butts against the sidewall of the adjacent vertical support column and a narrow limb spaced from the wide limb which is arranged to engage around and wedge against a flange at that side of the support column. The long edges of the two connector limbs are each formed with a series of vertically spaced, downwardly open hooks. The hooks on the narrow connector limb are arranged to engage in a series of vertically spaced framing slots formed in the front or rear wall of the support column adjacent the engaged flange, while the hooks on the wide limb extend beyond the abutting column side wall.

The other component of each connector assembly is an L-shaped connector lock arranged to be engaged about the other support column flange at the abutting column side wall. One leg of the connector lock is formed with a series of vertically spaced slots for receiving the hooks extending from the connector. The other leg carries a series of vertically spaced, downwardly open hooks. These are arranged to be received in a series of vertically spaced framing slots in the front or rear wall of the support column disposed opposite that connector lock leg. As will be described in more detail later, the connector and connector lock hooks and their various receiving slots are shaped and arranged so that, when the hooks are seated in their respective slots and the connector, or more particularly the sway brace or pallet bar attached thereto, is subjected to a vertical load, the connector and lock are drawn toward one another and clamped against the underlying flanges of the support column. This gives rise to a wedging action between the connector and support column which draws the connector and associated sway brace tightly and fixedly against the abutting side wall of the column. Thus, the present connection assembly creates a joint between the sway brace or pallet bar and the column having a very high degree of so-called fixity, meaning that up and down, as well as fore and aft rotations of the sway braces or pallet bars relative to the vertical column are prevented, as are rotational movements about the longitudinal axis of the brace or bar. Also prevented are vertical translatons, fore and aft translations and axial movements of the sway brace or bar. Still, due to its unique connector-lock clamping action, the connector assembly does not subject the column walls at the connection site to excessive stresses which might tend to tear or bend those walls.

As will be seen presently, the system also includes several cost-reducing features. For example, the pallet bars which are required to support heavy pallet loads are formed as box girders with extra wall thickness at those locations subjected to most stress so that the bars are extrememly resistant to bending forces. Yet each bar is composed of a pair of inexpensive cold roll-formed metal channels which snap together. Furthermore, one of the bar components doubles as the sway brace for the present system. Also, the vertical frames of the rack assemblies rest on footplates which are separable from the frames enabling the frames to be stacked closely so that less space is required when shipping the frames to the installation site. In addition, the system's shelf units are also stackable. Furthermore, they are adjustably, but securely, suspended from the vertical frames in such a way that a maximum number of such units can be utilized, commersurate with the height of the merchandise or stock supported on those units.

With all of the above advantages, the various components of the rack system can still be assembled quite easily by personnel at the installation site without their requiring any special tools. Also, if a particular system has to be disassembled or rearranged, that can also be done quite readily simply by releasing special keeper clips to be described and striking upward blows to the ends of the sway braces to release the connector assemblies from the vertical support columns to which they are clamped.

Thus, the present storage rack system should find wide application wherever the storage of stock or merchandise is required and particularly at those locations where customer orders are usually filled by picking items of merchandise from different containers arranged on the various shelves of a storage rack.

BRIEF DESCRIPTION OF THE DRAWINGS

For a fuller understanding of the nature and objects of the invention, reference should be had to the following detailed description, taken in conjunction with the accompanying drawings, in which.

DESCRIPTION OF THE PREFERRED EMBODIMENTS

Figure 1:
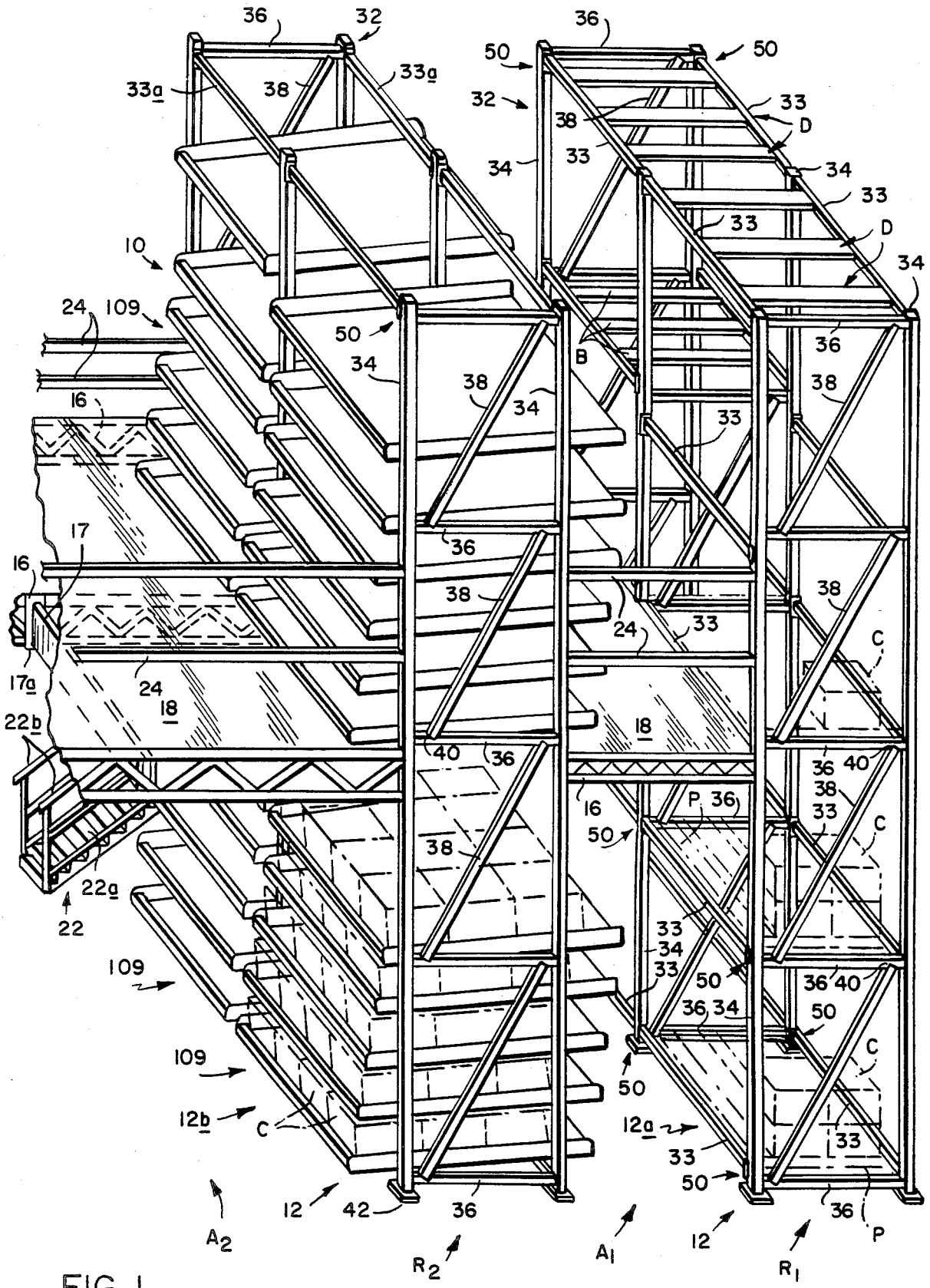
FIG. 1 is a fragmentary perpsective view of a storage rack system embodying the features of this invention.

Refer now to FIG. 1 of the drawings which shows a typical storage rack system 10 made in accordance with this invention and having a layout that might be used in a warehouse, for example. System 10 is composed of a number of knock-down rack assemblies 12 arranged in parallel rows $R_1$, $R_2$, etc. separated by aisles $A_1$, $A_2$, etc. For space reasons, the assemblies 12 are shown as being only two units or bays long. In actual practice, there woul be many bays in each assembly.

The rack assemblies 12 may all be situated at floor level or, as shown in FIG. 1, they may extend up more than one level depending upon the height of the building in which the system is located and the requirements of the user. For this, demountable bridge trusses or girders 16 are spaced along each aisle with their opposite ends removably connected to the rack assemblies 12 on opposite sides of the aisle, usually at a normal ceiling height, e.g. 9 feet. Floor joists 17 are suspended by saddle brackets **17*a* from these trusses and a deck 18**, composed of plywood panels, for example, is laid down on the joists to define each level or mezzanine above the floor.

As shown in FIG. 1, each deck 18 is extended beyond the ends of the rows of rack assemblies so that personnel can walk from one aisle to the other on the upper levels of the system. The deck extension (not shown) is supported by additional trusses 16 suspended from vertical columns (not shown) extending down to the floor beyond the end of each rack assembly 12. Access to each upper level or mezzanine is had by a staircase 22 whose upper end is removably coupled to a suitable beam (not shown) supported by adjacent trusses 16. The staircase 22 is a welded-together unit having steps **22*a* and a side railing 22*b* and its lower end rests on the floor or the next lower level of the system 10. To avoid accidents, horizontal beams or railings 24 are removably coupled between the rack assemblies 12 at the beginnings of the aisles. Similar railings 24** extend between the upper ends of the columns supporting the deck extension beyond the ends of the aisles.

There are several different types and sizes of rack assemblies 12, some or all of which may be present in a particular installation. In the system 10 specifically illustrated in FIG. 1, row $R_1$ contains a pallet storage rack assembly **12*a* commonly used for reserve storage to support pallets P loaded with cartons C of stock being warehoused. The assembly 12*a* extends from the ground to the top of system 10. Row $R_2$ contains a gravity flow rack assembly 12*b* that also extends from the floor to the top of the system. That is, the cases C stored in the assembly 12*b* automatically feed to the front of the assembly so that fresh stock is accessible to the stockmen moving up and down aisle $A_2$. This type assembly is most suitable for picking full cases or cartons C or for picking small stock or merchandise from open cases C stored therein. In this system, then, the row $R_1$ rack assembly may contain reserve storage to enable stockpersons moving along aisle $A_1$ to restock the gravity-flow rack assemblies 12*b* in row $R_2$ from the back so that such activity does not interfere with the picking and order filling being carried out in aisle $A_2$. In a typical system 10, there may be another gravity flow rack assembly 12*b* on the opposite side of aisle $A_2$ feeding cartons C toward that aisle for picking and a pallet storage rack assembly similar to assembly 12*a*** spaced beyond to provide reserve storage for that additional gravity flow rack assembly.

Still referring to FIG. 1 of the drawings, rack assembly **12*a* comprises a series of three vertical frames shown generally at 32 which support a series of vertically spaced horizontal pallet bars 33 at the front and rear of each bay. In some rack assemblies 12***a*, the lowest pallet bars 33 are omitted so that the loaded pallets P rest on the floor. Each vertical frame 32 shown in FIG. 1 and in greated detail in FIG. 2 includes a pair of spaced-apart support columns 34 rigidly connected by a series of vertically spaced horizontal beams 36, in the form of box girders whose opposite ends are welded to columns 34. Preferably, the lowest beam 36 of each frame is spaced somewhat above the lower ends of the associated columns 34. In addition, each vertical frame includes diagonal box-frame-type braces 38 between adjacent beams 36 whose opposite ends are welded to those beams. However, instead of being connected at or very near to the opposite ends of those beams, the braces are connected at locations 40 offset or spaced inward along the beams from the beam connections to the columns a unique distance for each size rack frame 32. These eccentric connections produce a vertical frame structure which, instead of being a stiff truss, constitutes a moment-resisting eccentric braced frame which can experience bending deformation even to a limited extent in the plastic range beyond its elastic limit. This allows the rack assembly to survive horizontal inertial loads imposed upon it due to building vibrations, earthquakes and the like even though it is supporting very heavy gravity loads, e.g. 2000 pounds per pallet P.

The illustrated rack assembly 12*a* is about forty inches deep, i.e. beams 36 are forty inches long. The beams are spaced about four and one half feet apart along the frame columns 34 and the diagonal braces 38 are connected to those beams at locations 40 spaced approximately five inches from the columns. It should be understood, however, that the beams 36 could be longer or shorter giving the support frames 32, and the assembly 12*a* as a whole, more or less depth depending upon the particular installation. Whatever the depth, the spacing between beams 36 remains about the same, but the spacing or offset between the brace locations 40 and columns 34 will vary. For example, in an assembly whose frames 22 are about eighty-eight inches deep, the brace offset is slightly less than ten inches. Thus, the illustrated moment-resisting eccentric braced frames 32 which comprises assembly 12*a* are much better able to withstand horizontal inertial loads than the relatively stiff trusses formerly used as the vertical frames in prior racks of this general type as typified by the one disclosed in U.S. Pat. No. 3,900,112 mentioned above.

Figure 3:
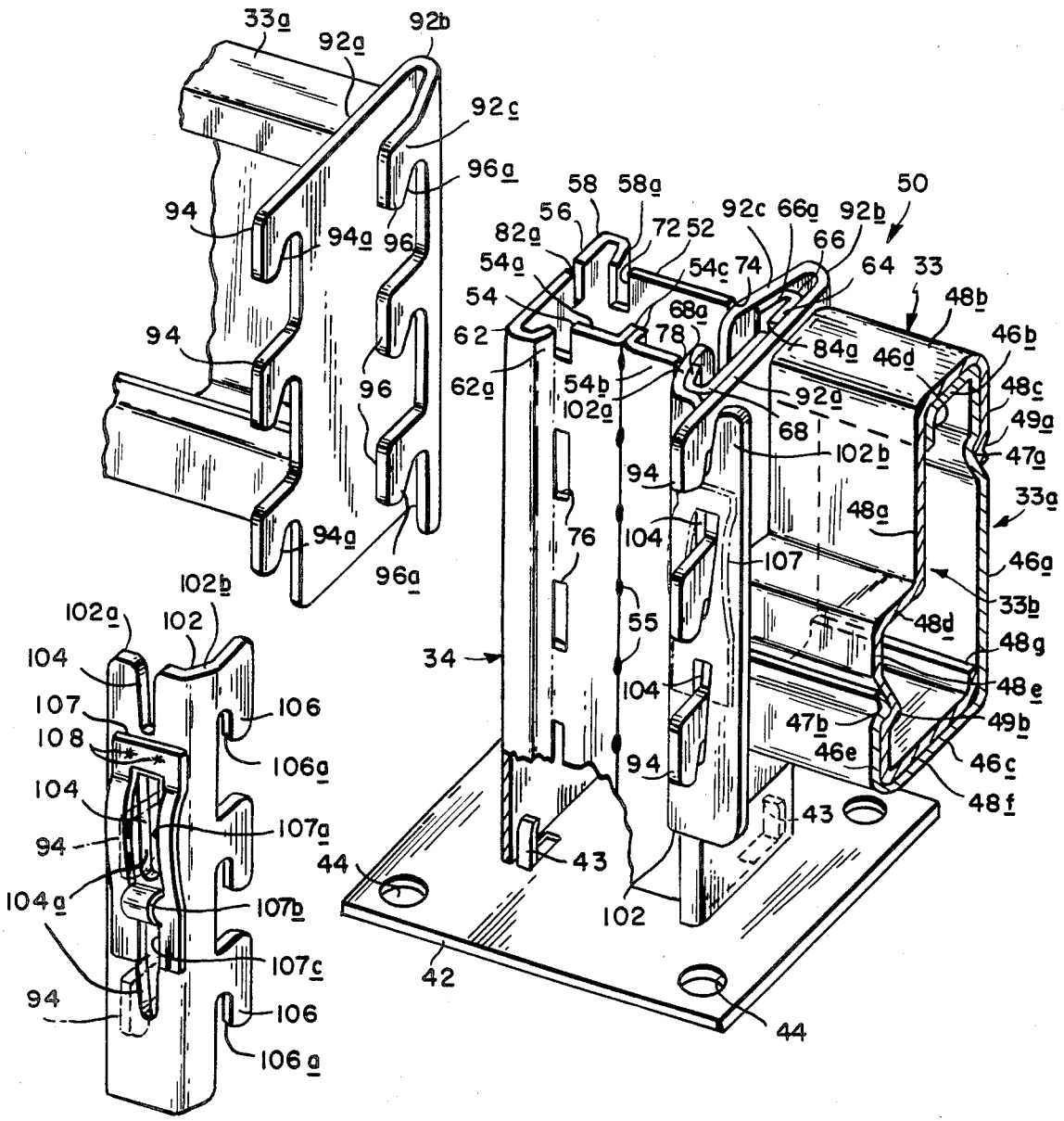
FIG. 3 is an exploded fragmentary perspective view on a still larger scale illustrating the connections between the pallet bars and sway braces and the vertical frames of the FIG. 1 system.

As best seen in FIG. 3, preferably each vertical frame 32 rests on a pair of footplates 42 removably connected to the lower open ends of the two frame columns 34 by fingers 43 struck from the plates and which project into the columns and resiliently engage their walls. If desired, the footplates 42 may be firmly anchored to the floor of the warehouse or other building, appropriate bolt openings 44 being provided in the plates for that purpose. Since the plates 42 are removable, the vertical frames 32 can be stacked close together when transporting the system 10 to the installation site, thus saving space for other components of the system. Also, since the ends of the columns 34 are open, they are easily field-spliced without tools to make longer columns if that is required for a particular system 10.

Referring to FIGS. 1 and 3, the pallet bars 33 comprising assembly 12*a* extend between adjacent vertical frames 32 at the front and back of the assembly and each front and rear bar pair may be located at any height on the frames as shown in FIG. 1. Each bar is composed of two mating sections 33*a* and 33*b* which snap together to form a box girder. Each bar section 33*a* is a generally rectangular cold roll-formed metal channel having a front wall 46*a* and top and bottom walls 46*b* and 46*c* respectively, the top wall rear edge margin 46*d* being turned downward. The channel bottom wall 46*c* extends rearwardly beyond top wall 46*b* and its rear edge margin 46*e* is bent upward. A longitudinal groove 47*a* is formed in the channel front wall 46*a* about one-third of the way down on that wall and the free edge of wall margin 46*e* is also grooved to form an inside rib 47*b*.

The other pallet bar section 33*b* is also a cold roll-formed metal channel. It is formed with a vertical rear wall 48*a* and a horizontal forwardly-extending top wall 48*b* whose leading edge margin is turned down to form a vertical front wall 48*c*. The lower edge margin of wall 48*a* is turned rearward to form a ledge 48*d* and then downwardly again to form an extended rear wall 48*e*. The channel extends forwardly below wall 48*e* to form a bottom wall 48*f* whose front edge margin is turned upwards to create a longitudinal upwardly-extending lip 48*g*. The free edge of front wall 48*c* is grooved to form an inside longitudinal rib 49*a* and a groove 49*b* extends along channel wall 48*e* midway between its upper and lower edges.

As shown in FIG. 3, the bar section 33*b* is shaped to cooperate with bar section 33*a* so that its top and front walls engage around the top and front walls of section 33*a* and so that its extended rear and bottom walls engage inside the rear and bottom walls of section 33*a*. When the two pallet bar sections are properly mated as shown, the rib 49*a* of section 33*b* snaps into groove 47*a* in section 33*a*, while the rib 47*b* of section 33*a* snaps into the grove 49*b* in section 33*b* thereby locking those two channel parts together. The tolerances and interferences of the two bar sections are such that, when they are snapped together as shown, it is practically impossible to separate them. Thus the two parts, each of which is a formed channel of uniform wall thickness, cooperate to form a very rigid box girder having double wall thickness only at those locations where needed at the bottom and top of the bar where the stress caused by a vertical load is a maximum. Therefore, the bar is well able to support very heavy pallet loads without buckling or excessive deflection; yet its material cost is kept to a minimum.

When a pair of pallet bars 33 is properly clamped to support columns 34 at the front and rear of rack assembly 12*a*, as will be described presently, they are positioned to support the front and rear edge margins of a pallet P. Also, the bar ledges 48*d* face inward so that lengths of 2×6 boards or slats, for example, can be set on those ledges as shown at B in FIG. 1. These boards will prevent a loaded pallet from falling down through the rack in the event that its front or rear edge margin becomes displaced from the underlying pallet bar 33.

The opposite ends of each pallet bar 33 are connected to the adjacent frame columns 34 by special releasable connector assemblies shown generally at 50. Each connector assembly 50, in conjunction with the column 34 structure, achieves a very high degree of fixity between the connected-together pallet bar and column. FIG. 3 of the drawings shows the column 34 and connector assembly 50 in detail. As seen there, each column is a preblanked cold roll-formed metal part having the general shape of a hollow I-beam which is symmetrical about its longitudinal or vertical axis. That is, the column has a flat front wall 52 as well as a parallel rear wall 54 composed of two longitudinal sections 54*a* and 54*b* having opposing inturned edge margins 54*c* secured together by a series of vertically spaced welds 55. Each column also has a side wall 56 formed with front and rear truncated flanges 58 and 62 respectively. The column is completed by a second side wall 64 formed with front and rear flanges 66 and 68 respectively. For reasons that will become apparent, the opposing flange walls 58*a* and 66*a* at the front of the column converge, as do the corresponding flange walls 62*a* and 68*a* at the rear of the column. In fact, the flange wall pairs 58*a*, 62*a* and 66*a*, 68*a* at the opposite sides of the column each define planes which intersect along an imaginary line inside the column.

Figure 4:
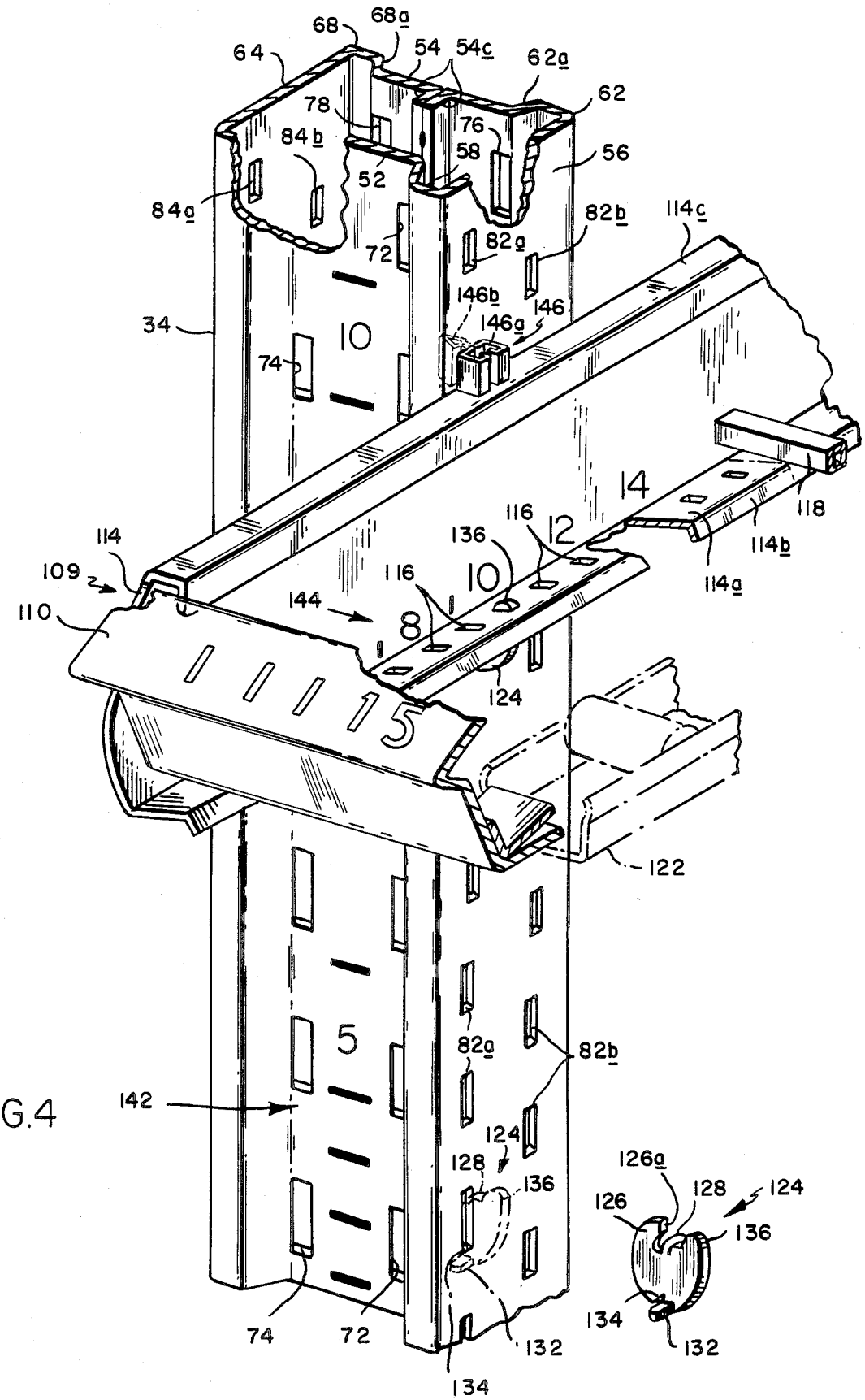
FIG. 4 is a fragmentary perspective view on an even larger scale illustrating the mode of adjustably mounting the gravity flow shelf units of the FIG. 1 system to the vertical frames thereof.

Two series of vertically spaced-apart vertical framing slots 72 and 74 are formed at the opposite sides of the column front wall 52 adjacent flanges 58 and 66 respectively. Two series of similar slots 76 and 78 are located in the column rear wall 54 adjacent flanges 62 and 68, the corresponding slots in the four series all being located at the same heights on the column, say every two inches. Additional series of vertically spaced, smaller slit-type vertical slots are present in the column side walls 54 and 64. More particularly, as best seen in FIG. 4, a series of vertical slots 82*a* is formed in column wall 56 adjacent flange 58 and a second parallel column of slots 82*b* are located in that same wall adjacent flange 62, the two series of slots being vertically offset or staggered. Similarly located and offset series of slots 84*a* and 84*b* are provided in the column side wall 64. These various side wall slots are used to locate and help support the shelf units 33 as will be described later. The forming of the columns 34 as described above as box girders in a hollow I-beam configuration makes the columns extremely resistant to bending and torsional-flexural buckling. At the same time, that particular column structure cooperates and coacts with the connector assemblies 50 which attach the various pallet bars 33 to the columns to achieve very secure and fixed bar-column connections. Indeed, each such connection is designed to provide a fixed, moment connection to resist combinations of vertical loading and/or lateral loading where the latter loading can be either in the aisle-wise direction or the front-to-back direction.

As shown in FIG. 3, the connector assemblies at opposite ends of each pallet bar 33 are mirror images of one another. Each comprises an elongated channel-shaped stamped metal connector 92 whose cross section has the general shape of the letter J. Thus, the connector has a long limb 92*a* butt welded to the ends of pallet bar sections 33*a* and 33*b* making it impossible to separate those sections and further increasing the stiffness and strength of the pallet bar 33 as a whole. Each connector 92 further includes a wedge-shaped front portion 92*b* which curves or angles away from limb 92*a* and a short limb 92*c* which extends rearwardly from portoin 92*b*, being spaced generally parallel to limb 92*a*. A series of three vertically spaced, downwardly open hooks 94 are formed at the rear edge of connector limb 92*a* and a second series of three vertically spaced, downwardly open hooks 96 are present at the rear edge of connector limb 92*c*, the uppermost hooks in the two series being located right at the top of the connector and ther other corresponding hooks in the two series being positioned at the same heights on the connector. The hooks 96 are shaped and arranged so that they can hook into vertically adjacent slots 74 or 76 in the front or rear wall of column 34.

The remaining component of the connector assembly 50 is a connector lock 102 best seen in FIG. 3 to be an elongated stamped metal part formed as an L-shaped section with approximately equal legs. One leg 102*a* of the lock is formed with a series of three vertically spaced vertical slots 104, the uppermost slot being an open slot extending to the upper edge of the connector lock. The other lock leg 102*b* is provided with a series of three vertically spaced downwardly open hooks 106. The hooks 106 are located more or less at the same heights on the connector lock as the slots 104 with their lower ends extending somewhat below the lower ends of those slots. These hooks are also shaped and positioned so that they can hook into vertically adjacent slots 72 or 78 in the front or rear wall of column 34.

To connect an end of a pallet bar 33 to a column 34, the connector lock 102 is first engaged to the column at the location on the column where the connection is to be made. Assume, for example, that the right-hand end of a pallet bar 33 is being connected to the front center column 34 of the rack assembly 12*a* illustrated in FIG. 1. In this event, first the connector lock 102 shown at the right-hand side of FIG. 3 is positioned at the appropriate height on the column and its hooks 106 are hooked into the three closest slots 78 in the rear wall of the column. The openings under hooks 106 are more or less vertical so that the hooks rest on the lower edges of slots 78, with the lock engaging snugly around column flange 68 so that its leg 102*a*, including the slots 104 therein, extend beyond the column side wall 64. Next, the connector 92 is positioned opposite lock 102 with its limb 92*a* engaged flush against the column side wall 64. The connector is then slid rearwardly toward column flange 66 so that its hooks 96 project into the three nearest slots 74 in the column front wall, while at the same time its hooks 94 engage in the slots 104 of the connector lock.

If now a vertical load is placed on bar 33 and, more particularly its connector 92, the connector hooks 94 are urged down into the connector lock slots 104, while the connector hooks 96 are pressed down into slots 74 at the front of the column. The engaging undersides of those hooks, namely edges 94*a* and 96*a* respectively, are slanted or inclined upwardly-forwardly, as shown in FIG. 3, so that a wedging action occurs which draws the connector 92 toward the column flange 66 while, at the same time, the connector and connector lock 102 are drawn together with the column 34 clamped between them.

As mentioned previously, the connector portion 92*b* is curved or wedge shaped and the column flange 66 with its convergent wall 66*a* is truncated. Therefore, as the connector hooks 94 and 96 are pressed further into their respective slots 104 and 74, the connector portion 92*b* is urged ever more firmly against against the flange 66. That engagement, in turn, causes the convergent flange wall 66*a* to wedge the connector limb 92*a* very tightly against the column side wall 64 over the entire height of the connector. In addition, the outboard walls 104*a* of the connector lock slots 104 are downwardly-inwardly tapered or slanted so that, as the connector hooks 94 are urged downwardly into those slots, they are wedged toward the column side wall 64 thereby drawing the rear edge margin of connector limb 92*a* tightly against the column sidewall 64 along the entire height of the connector.

Thus, the connector assembly 50 described herein clamps the column between connector 92 and lock 102 so that the pallet bar cannot rotate up and down or fore and aft relative to the column. Nor can the bar rotate about its own longitudinal axis. In addition, the aforesaid clamping action draws the connector 92 at the end of the bar very firmly against the side wall of the column, thereby preventing vertical as well as fore and aft translations of the end of the pallet bar 33 relative to the column. Therefore, the rack assembly 12*a* with its pallet bars 33 connected to its vertical frame columns with this high degree of fixity can withstand normal gravity loads due to the product stored thereon—as well as vertical inertial loads caused, for example, by the dropping of loaded pallets on the pallet bars. Further, the rack assembly has little tendency to sway or deform even when strong horizontal or lateral inertial forces, as might be caused by building vibrations or strong earth tremors, are applied to the upper regions of the assembly.

It is important to note also that, unlike the case with prior connectors of this general type, the present assembly 50 does not impose excessive localized stresses to the column as might cause its walls to bend or tear. Rather, assembly 50 achieves its very strong clamping connection to the column and its high degree of fixity primarily due to the hooking-wedging connection between connector 92 and its lock 102. Those members are heavy gauge cold roll-formed metal parts which are well able to withstand localized stresses imposed on them due to their interconnection. Moreover, the clamping engagement of those members to the walls of the column occurs over a relatively large surface area around the flanged side wall of the column. Therefore, while the connector hooks 94 and lock hooks 106 do engage the front and rear walls of the column respectively, such engagements occur right adjacent the outwardly angled column flanges 66 and 68 respectively where the walls are firmly clamped between and supported by the connector and its lock.

While the connector assembly 50 does firmly connect the end of each pallet bar 33 to the adjacent column 34, achieving a joint with a very high degree of fixity, the assembly can be uncoupled or disconnected from the column very easily in the event that is required to relocate the bars or to dismantle the rack assembly. Furthermore, this can be done without any special tools; it simply requires an upward blow from a board or hammer against the end of the particular bar 33. This lifts the connector and lock hooks 94 and 106 from their seats in column slots 74 and 78 sufficiently to release the clamp. The end of the bar can then be lifted up sufficiently to permit the connector hooks 94 and 96 to be withdrawn from their respective slots 104 and 74, thereby disconnecting the end of the bar from the column. The connector lock 102 can then be removed from the column by lifting it sufficiently to permit its hooks 106 to be withdrawn from the slots 78 in the column.

In the embodiment of rack 10 specifically illustrated herein, means are provided for releasably locking together the connector 92 and lock 102 of each connector assembly 50 so that a pallet bar cannot accidentally detach from its columns 34. More particularly, and as best seen in FIG. 3, a generally rectangular sheet metal keeper clip 107 is attached at one end by spot welds 108 to connector lock 102 so that the clip covers the middle slot 104 and part of the lowest slot 104. Each clip has a rectangular slot 107*a* punched out in register with the middle lock slot 104, with the punched-out metal being bent down to form a small clip handle 107*b*. Below the handle, the clip is bent to form a longitudinal rib 107*c* which projects into the lowest lock slot 104 as shown.

When lock 102 is being clamped to connector 92 about column 34 as described above, the connector hooks 94 extend through the lock slots 104 as shown in dotted lines in FIG. 3. The middle hook 94 projects through clip slot 107*a* and the lowest hook 94 pushes the lower, free end of the clip away from the lock 102 until that hook clears the lower edge of its slot 104. At that point, the hook can be moved down in that slot until it clears the lower edge of the clip. The clip, being resilient, snaps back against lock 102 so that its rib 107*c* engages in the portion of slot 104 above hook 94 as shown in FIG. 3. In that position, the clip rib acts as a short rigid column preventing upward movement of the connector 92 relative to the lock 102. Preferably, clip 107 is bowed or arched as shown so that it has some lengthwise compliance. In this way, if the connection assembly is subjected to an unusually heavy load, so that an upward force is applied to the lower edge of the clip by the lowest hook 94, the clip will flex rather than break away from lock 102 at its welds 108.

The connector assembly 50 at the left-hand end of bar 33, shown at the left in FIG. 3, is a mirror image of the one at the right-hand end just described and it functions in exactly the same way to releasably couple the left-hand end of a pallet bar to the right side of the adjacent column 34.

The same connector assemblies 50 are used to couple the opposite ends of the bars 33 to the columns 34 at the rear of the rack assembly 12*a* illustrated in FIG. 1. In this case, however, assuming that the columns are oriented in the same way, i.e. the column front walls 52 face the front of the assembly, the connector 92 is clamped against the column flange 62 or 68 at the rear of the column, while the lock 102 is engaged to the flanges 58 or 66 at the column front. In other words, since each column is essentially symmetrical about its vertical or longitudinal axis, with a given pair of connector assemblies 50, connections can be made to both sides of a column at the front or rear of the column. The same connection assemblies 50 may be used to connect the ends of trusses 16 shown in FIG. 1 and the beam that supports the upper end of staircase 22 to columns 34. Since assemblies 50 can attach bars 33 right at the tops of columns 34, a continuous flat deck D can be provided all along the top of rack assembly 12*a* as shown in FIG. 1.

Figure 2:
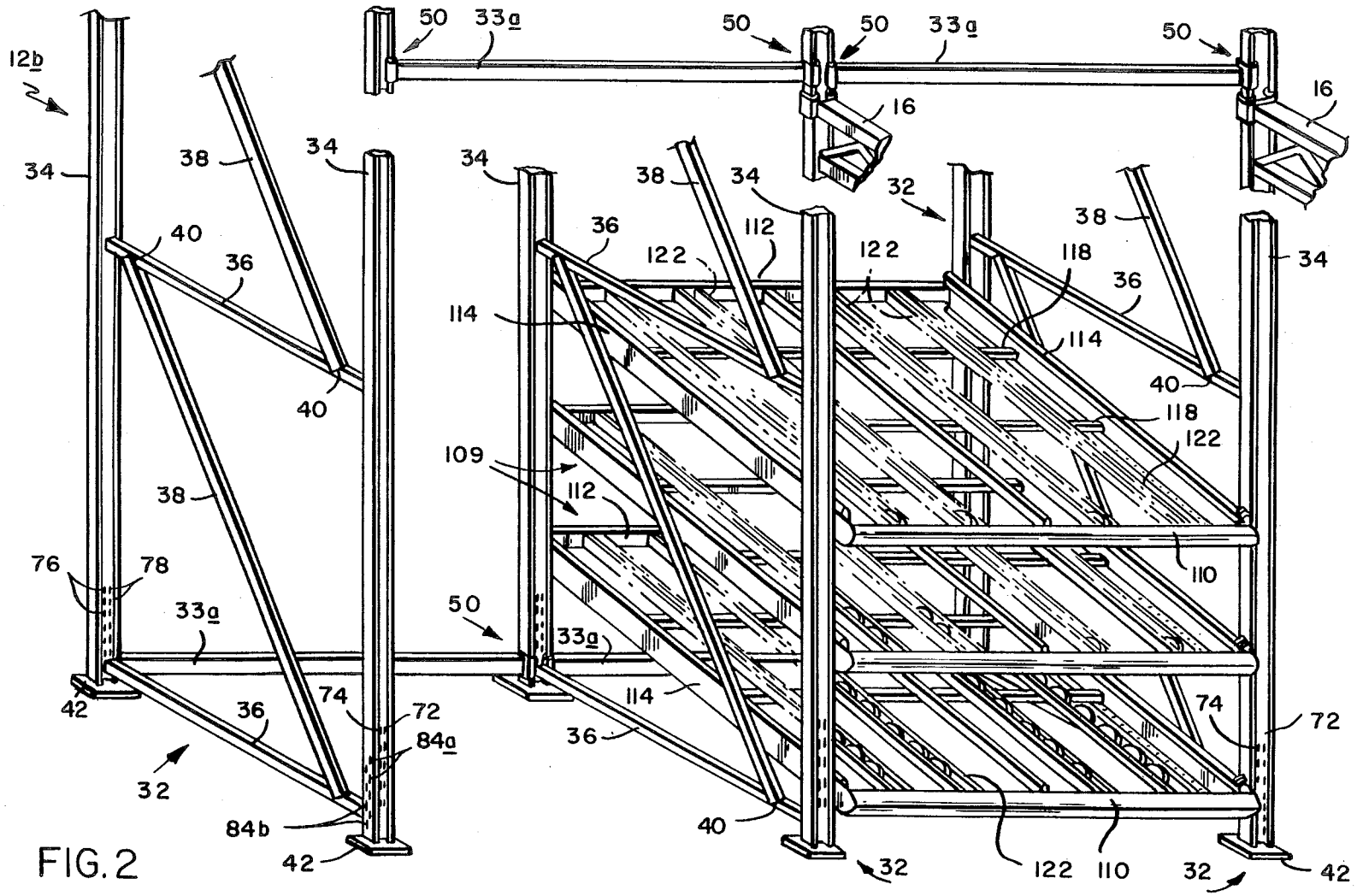
FIG. 2 is a fragmentary perspective view on a much larger scale showing certain components of the rack system in greater detail.

Referring now to FIGS. 1 and 2, the very same components used to construct the pallet storage rack assembly 12*a* are used to form the gravity flow rack assembly 12*b* in rack system 10. That is, assembly 12*b* also comprises spaced-apart vertical frames 32. Here, however, the frames are maintained in spaced relation by horizontal sway braces. Since these members are not exposed to heavy vertical loads as are the pallet bars, they do not have to be as resistant to bending. However, to minimize parts costs, one of the sections used to form the pallet bar 33, namely section 33*a*, is used also for the sway brace. In a typical assembly 12*b*, such sway braces 33*a* are connected between the lower ends of adjacent columns 34 at the rear of the assembly. They are also attached between adjacent columns 34 at the level of each floor or mezzanine and at the very top of the columns at both the front and rear of the assembly. Actually, because of the unique moment-resisting eccentric braced design of the vertical frames 32, fewer sway braces are required for this system than for prior racks of its general type. Also, the very same connection assemblies 50 whose connectors 92 are welded to the opposite ends of the braces 33*a*, are used to clamp those braces to the adjacent columns 34 as shown in FIG. 2.

As best seen in FIGS. 2 and 4, the vertical frames 32 support a series of vertically spaced-apart gravity-flow shelf units 109 in each bay of rack assembly 12*b*. In the illustrated rack assembly having frames 32 which are forty inches deep, the shelf units are typically about sixty inches deep or long. In a larger assembly, the vertical frames might be eighty-eight inches deep to support shelf units that are about one hundred twenty inches long. Each shelf unit is composed of front and rear transverse frame members 110 and 112 respectively and opposite, mirror-image side members 114 joined at their ends to form a rectangular frame. Cross members 118 are connected between the vertical webs of side members 114 to strengthen the shelf unit. A series of laterally spaced-apart gravity-feed roller tracks 122 are supported at their opposite ends from the front and rear frame members 110 and 112 of each shelf unit. The illustrated tracks are substantially the same as the ones disclosed in the aforementioned U.S. Pat. No. 3,900,112 and connect to the front and rear frame members of the shelf unit in the same way described there.

As shown in FIG. 4, the lower edge margin of the vertical web of each shelf frame side member 114 is turned inward beyond 90° to form a relatively wide ledge 114a which inclines from the side of the web so that only its outer edge engages the underside of cross members 118. Also, a narrow edge margin of that ledge is bent down to form a lip or flange 114*b* which makes an obtuse angle with ledge 114*a*. The upper edge margin of the vertical web of each side member 114 is also turned inward over ledge 114*a* to form a rib or flange 114*c*. These flanges at the upper and lower edges of side member 114 rigidify that member. Transverse slots 116 are spaced apart along each member ledge 114a for a distance of about twenty inches from the front frame member 110. These slots are used to adjustably suspend the shelf units 109 from columns 34 as will be described presently.

Still referring to FIG. 2 and especially to FIG. 4, each shelf unit is suspended by way of its side members 114 from the four columns 34 defining the rack assembly bay in which the shelf unit is located. For this purpose, special hanger clips 124 are utilized to adjustably support the shelf unit side members from the columns. Each clip 124 is a small, low profile, rigid, stamped metal part whose thickness is slightly less than the width of the slots 82*a*, 82*b*, 84*a* and 84*b* in the side walls of column 34. It has a generally ovular shape with an upwardly-forwardly extending finger 126 at the rear of the clip which terminates in a flat, generally vertical end wall 126*a*. Spaced slightly forwardly of and below wall 126*a* is a tab 128 which extends laterally to one side of the clip. A similar tap 132 at the bottom of the clip directly below tab 128 extends laterally in the opposite direction from tab 128. A small vertical wedge-shaped notch 134 is present at the bottom of the clip just forwardly of tab 132 and the mouth of that notch, as well as the spacing between finger wall 126*a* and tab 128, are slightly larger than the thickness of the column side walls 56 and 64. The clip 124 is further formed with a nose 136 which projects upward just forward of tab 128 more or less to the same height as finger 126.

Each clip 124 is arranged and adapted so that its rear edge margin, including finger 126, can be inserted into a slot 82*a*, 82*b*, 84*a* or 84*b* in column 34 until the tabs 128 and 134 engage the relevant column side wall as shown in dotted lines in FIG. 4. The clip is then free to slide downward in the slot until the lower edge of the slot wedges into the clip notch 134. Furthermore, the clip is free to cock or tilt outward on the slot lower edge until the finger wall 126*a* engages the inside surface of the column side wall. When the clip is seated in the column slot in this fashion, further downward or tilting movement of the clip is prevented. Also, lateral cocking or swinging motions of the clip are inhibited by the engagement of the clip fingers 128 and 132 against the column side wall on opposite sides of the slot. The clip is thus connected very securely to the column; yet it can be removed easily simply by lifting the clip sufficiently to withdraw the slot edge from the clip notch 134 and then withdrawing the clip from the slot.

The clip 124 attached as aforesaid to column 34 is adapted to support one end of a shelf unit side member 114. Consequently, four clips are positioned on the four columns 34 supporting the particular shelf unit at the heights on those columns that will give the shelf unit the desired front-to-back incline. Next, the shelf unit is positioned in the rack bay so that its side member ledges 114*a* rest on the four clips. Then the front of the shelf unit is lifted slightly and the unit slid on the rear clips forwards or backwards relative to vertical frames 32 until the unit projects the desired distance from the fronts of those frames. Finally, the front end of the unit is lowered so that the front pair of clips engage in the nearest ledge slots 116 thereby fixing that fore and aft position of the shelf unit.

As mentioned previously, the side member ledges 114*a* are inclined. Therefore, the reaction force of the clips against that weighted surface wedges the vertical web of the side member tightly against the column side wall. Also, the edge of that member, i.e. the portion of ledge 114*a* inboard of an engaged-in slot 116 at the front of the shelf unit rests on the engaging clip tab 128. Therefore, downward forces are distributed over the opposing surfaces of that ledge and tab so that there is little tendency for the plate to tear adjacent to a slot 116 at the front of the shelf unit when the unit is subjected to a vertical load. Still further, the ledge slots 116 are made slightly wider than the clip nose 136 to permit the shelves to be supported by the columns at various front to rear inclinations. Preferably also, the ledge lip 114*b* on each side member 114 is angled outwardly as described so that the shelf units 109 will nest when stacked to facilitate the storage, shipping and handling of the shelf units. That is, the ledges 114*a* and their lips 114*b* will engage on and interfit with the upper flange 114*c* of the underlying shelf unit in the stack to stabilize the stack.

Column side wall slots 82*a* and 82*b* (as well as slots 84*a* and 84*b*) are staggered to permit the shelf unit side members 114 to be positioned at almost any height on columns 34 within a selected interval, say about an inch. The locating of the four clips 124 required to support a given shelf unit 109 is simplified by providing a scale 142 on the front wall 52 of each column as shown in FIG. 4. It is important to note also that, while the clips 124 firmly support the shelf units, they are quite small and compact. Therefore, they can be positioned on the columns 34 very close to the lower ends of the columns, unlike the shelf supports in other racks such as the one described in the aforementioned U.S. Pat. No.

3,900,112. Consequently, more vertical space is available in each rack bay for shelf storage.

As each shelf unit 109 can be adjustly positioned heightwise in the rack assembly 12*b*, at any desired angle of inclination, so too can it be adjustably positioned in the fore and aft direction in the assembly. This simply involves lifting the front of the shelf unit slightly and moving it fore or aft within the rack bay to the right position and then lowering the front end so that the clips 124 engage in the desired side plate ledge slots 116. To facilitate this fore and aft positioning, scales are inscribed on the inside faces of the vertical webs of the side members 114 as shown at 144 in FIG. 4. This insures that the clips on opposite sides of the shelf unit will be engaged in corresponding slots 116 so that the shelf unit is supported in a squared-up condition. The shelf units of a given rack assembly 12*b* may be positioned directly above one another in a "squarefront" arrangement as shown in FIG. 2 or the shelf units may be "layback" as shown in FIG. 1 to afford easier access to cartons C and totes supported on the shelf units because the tops of the cartons and totes are exposed making it easier to pick articles from the cartons and totes. Of course, the "profiling" of the shelf units in the rack assembly 12*b* as described can be accomplished without any tools or field measurements.

To prevent the shelf units 109 from being disengaged inadvertently from the columns, locking clips indicated generally at 146 in FIG. 4 may be releasably engaged to the column just above the shelf unit side members 114. Each locking clp is a formed spring-metal part having a relatively wide head portion 146*a* and a tail portion 146*b* formed as a barb which can snap into a slot 82*a*, 82*b*, 84*a* or 84*b* just above the top of the shelf unit side member 114. The clip is removed from the slot by squeezing the opposite sides of the head portion 146*a* together. This bends and narrows tail portion 146*b* sufficiently to permit its withdrawal from the slot.

It will be seen from the foregoing, then, that the rack system 10 described herein achieves all of the objectives stated at the outset. Accordingly, it should find wide application wherever the storage of merchandise or other stock is required and particularly in those locations where orders must be filled by picking merchandise or stock from a number of different cases or cartons.

It will be seen further that the objects set forth above, among those made apparent from the preceding description, are efficiently attained, and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A rack system comprising

A. a series of spaced-apart frame membering elongated frames each of which includes a pair of similar spaced-apart parallel columns and a series of one or more beams connected between the columns of said pair at spaced-apart locations therealong, each frame column having a front wall, a back wall, a pair of parallel side walls and fore and aft-extending flanges adjacent to each side wall, said walls and flanges together defining a completely closed box girder having longitudinal symmetry and a cross-section having the general shape of an I-beam, the opposing surfaces of the flanges on each said column diverging to define inclined planes which intersect along a line parallel to the longitudinal axis of said column, a series of longitudinally spaced-apart slots formed in the front and rear walls of each of said columns adjacent to each of the flanges on said column;

B. at least one pair of frame members extending between corresponding columns of adjacent frames at spaced-apart locations along said frames;

C. means releasably connecting the opposite ends of each frame member to a column of a said adjacent frame, each said connecting means including 1. an elongated connector mounted to a said frame member end, said connector including a first limb having a longitudinal edge, a second limb having a longitudinal edge, and a bridging portion connecting said first and second limbs, said first limb being longer than the front-to-back depth of each frame column, said second limb being shorter than said first limb and said bridging portion defining a gap between said limbs, a series of similar hooks spaced apart along said edge of said second connector limb, said connector engaging a said column so that its bridging portion wedgingly engages one of said pair of flanges at the front or rear wall of that column so that said series of hooks hook into the series of frame member engaging slots adjacent to that flange, with said first connector limb lying flush against said one column side wall, and 2. a connector lock having first and second legs oriented at an angle to one another, each said leg having an edge, a series of similar hooks spaced along said edge of said first leg, said connector lock engaging said other of said pair of flanges so that its said series of hooks hook into the series of column slots adjacent to said other of said pair of flanges and coacting means on said edge of said first connector limb and on said second connector lock leg which interfit so that when a load is applied to said each horizontal frame in a direction parallel to the frame columns, the associated connector and connector lock are drawn together very tightly against their respective column flanges and said connector is wedge against the column side wall between said flanges so as to develop a high degree of fixity between that horizontal frame member and the adjacent column.

2. The rack system defined in claim 1 wherein each vertical frame also comprises a diagonal brace extending between the adjacent beams of said beam series, each said brace having its opposite ends connected to said adjacent beams at locations spaced a selected appreciable distance from the connections of said adjacent beams to the nearest columns, said distance being related to the lengths of said beams so that the frame constitutes a moment-resisting eccentric braced frame structure.

3. The rack system defined in claim 1 wherein each frame member comprises first and second mating metal channels which interfit to form a box girder having top and bottom walls and a pair of side walls.

4. The rack system defined in claim 1 and further including

A. a series of vertically spaced shelf units positioned in the space between adjacent vertical frames; and B. means for adjustably securing the opposite sides of said shelf units to the columns of said adjacent frames.

5. The rack system defined in claim 4 wherein each shelf unit includes

A. a pair of spaced-apart parallel side members;

B. a pair of spaced-apart parallel transverse members connected to the opposite ends of the side members to form a generally rectangular frame;

C. a plurality of spaced-apart parallel roller tracks positioned between said side members; and D. means for releasably connecting the opposite ends of said tracks to said transverse members.

6. The rack system defined in claim 5 wherein said securing means include

A. a series of vertically spaced slots in the side walls of said frame columns adjacent to the shelf unit side members; and B. hanger clips engaged in said side wall slots and projecting under said shelf unit side members so as to support the shelf unit from below.

7. The rack system defined in claim 2 wherein said columns, beams and braces are all box girders.

8. The rack system defined in claim 7 and further including

A. a pair of foot plates for each said frame; and

B. means on the plates for releasably engaging into the ends of the columns at one end of the frame.

9. The rack system defined in claim 1 wherein each horizontal frame member is a channel-shaped sway brace.

10. The rack system defined in claim 1 wherein each horizontal frame member is a pallet bar.

11. The rack system defined in claim 10 wherein each said bar comprises a pair of channels the walls of which overlap and interfere to form a tube having double wall thickness at selected locations around the tube that are subjected to the most stress when the bar is subjected to a vertical load.

12. The rack system defined in claim 1 wherein

A. each connector means include an elongated formed metal plate with a generally J-shaped cross section whose said hooks are located at the end of the short limb of the plate, said plate also hanging openings and whose said openings are located adjacent to the end of the long limb of the plate; and B. each connector lock means include an elongated formed metal L-shaped section whose said hooks are located at the end of one leg of the section, said plate also having openings and whose said openings are located adjacent to the end of the other leg of the section and whose said openings are vertical slots whose edges proximal to said other leg end are inclined downwardly-inwardly away from said other leg end.

13. A rack system as defined in claim 1 and further including

A. a series of vertically spaced-apart shelf units located in the space between the adjacent columns of adjacent pairs of vertical frames; and B. a series of vertically spaced side wall slots, a hanger clip hooked into one of said sidewall slots in the series of sidewall slots of each said adjacent column at a selected height on said column, all of said clips on said adjacent columns projecting into said space so as to engage under opposite sides of and thereby support each shelf unit of said series at a selected elevation and front-to-back inclination on said adjacent columns.

14. The rack system defined in claim 13 wherein each said clip is a generally flat plate having A. a notch in its lower edge which seats on the lower edge of the sidewall slot into which the clip is hooked;

B. an upwardly extending arm which engages the inside surface of the column side wall above said sidewall slot;

C. an upwardly extending nose which projects into said space opposite said one of said slots so as to engage under the shelf unit; and D. a pair of tabs located between said notch and said nose which project laterally in opposite directions adjacent the column side wall containing said one of said sidewall slots to prevent the clip from rocking laterally in said one of said sidewall slots.

15. The rack system defined in claim 14 wherein each shelf unit comprises

A. a pair of spaced-apart mirror image side frames;

B. a pair of spaced-apart transverse members connected to the ends of the side members to form a generally rectangular frame, each side frame including (1) a vertical web, (2) a ledge extending along the lower edge of the web which projects toward the oposite side member, and (3) a series of holes spaced along said ledge and arranged to receive the nose of a clip supporting that shelf unit.

16. The rack system defined in claim 3 wherein said channel walls overlap at the top and bottom walls of said girder and around segments of said girder side walls contiguous with said top and bottom walls.

17. The rack system defined in claim 16 and further including coacting means on said channel walls which resiliently interfit and snap together to maintain said channels in said box girder form.

18. A rack system comprising

A. a series of spaced-apart vertical frames each of which includes a pair of similar columns, each frame column having a front wall, a back wall and a pair of flanged side walls defining a closed, flanged box girder having the general shape of an I-beam;

B. a series of vertically-spaced horizontal frame members extending between corresponding columns of adjacent vertical frames;

C. means for releasably connecting the opposite ends of each frame member to said adjacent columns, each said connecting means clampingly engaging about the adjacent flanged side wall of the adjacent column to obtain a high degree of fixity between the horizontal frame members and the vertical frames;

D. one or more series of vertically spaced-apart slots formed in each side wall of each frame column;

E. a series of vertically spaced-apart shelf units located in the space between the adjacent columns of adjacent pairs of vertical frames, each unit having a front, back and two side members, said side members each having ledges extending generally inwardly toward the middle of said unit, each ledge having a plurality of ledge slots; and F. a hanger clip hooked into one of said sidewall slots in the series of slots of each said adjacent column at a selected height on said column, each of said clips on said adjacent columns projecting into said space and engaging a respective ledge supporting each shelf unit of said series at a selected elevation and front-to-back inclination on said adjacent columns, said ledges of each said shelf unit being angled upwardly so that the clips engaging under said ledges tend to wedge the side frames against the adjacent columns which support that unit, each said clip constituting a generally flat plate having
   (1) a notch in its lower edge which seats on the lower edge of the sidewall slot into which the clip is hooked,
   (2) an upwardly extending arm which engages the inside surface of the column side wall above said slot,
   (3) an inwardly extending nose which projects into said space opposite said one of said slots and engages a ledge slot in a ledge of the shelf unit, and
   (4) a pair of tabs located between said notch and said nose, which tabs project laterally in opposite directions adjacent to the column side wall containing said one of said slots thereby said clips from rocking laterally in said one of said slots.

19. The rack system defined in claim 18 wherein each side frame of each shelf unit also includes a skirt depending from said ledge and angled toward the opposite side frames of that unit so that when a plurality of said shelf units are stacked, the ledges and skirts of the side frames of each shelf unit nest on the upper edges of the side frame webs of the underlying shelf unit so that the resultant stack of shelf units is relatively stable.

20. The rack system defined in claim 18 and further including keeper clips A. releasably engaged in the sidewall slots above said ones of said slots of said adjacent columns supporting each shelf unit; and B. overhanging said shelf unit side frames to prevent said clip noses from being withdrawn from said ledge slots.

21. A rack system comprising

A. a plurality of elongated columns, each column having a front wall, a rear wall, a pair of parallel side walls and a pair of fore and aft-extending flanges adjacent to each side wall, said walls and flanges together defining a completely closed box girder having the general shape of an I-beam, the opposing surfaces of said flanges diverging so that each flange is wedge-shaped in cross-section, a series of longitudinally spaced apart slots in the front and rear walls of the column adjacent to each of the column flanges;

B. a plurality of elongated frame members, each said frame member having opposite ends for connection to an adjacent column; and C. means for connecting each end of each frame member to an adjacent column, each said connecting means including
   1. a connector mounted to an end of a said frame member, said connector including a first limb having a longitudinal edge, a second limb having a longitudinal edge, and a bridging portion connecting said first and second limbs, said first limb being longer than the front-to-back depth of said column, said second limb being shorter than said first limb and said bridging portion defining a gap between said limbs, a series of similar hooks spaced apart along said edge of said second connector limb, said connector engaging about a said column so that its bridging portion wedgingly engages one of said pair of flanges at the front or rear wall of that column so that said series of hooks hook into the series of column slots adjacent to that flange, with said first connector limb lying flush against said one column side wall, and
   2. a connector lock having first and second legs oriented at an angle to one another, each said leg having an edge, a series of similar hooks spaced along said edge of said first leg, said connector lock engaging about said other of said pair of flanges so that its said series of hooks hook into the series of column slots adjacent to said other of said pair of flanges and coacting means on said edge of said first connector limb and on said second connector lock leg interfit so that when a load is applied to said each horizontal frame in a direction parallel to the frame columns, the associated connector and connector lock are drawn together very tightly against their respective column flanges and said connector is wedged against the column side wall between said flanges so as to develop a high degree of fixity between that horizontal frame member and the adjacent column.

* * * * *